United States Patent [19]

Gnadig et al.

[11] Patent Number: 4,497,358

[45] Date of Patent: Feb. 5, 1985

[54] PROCESS FOR THE MANUFACTURE OF A STEEL BODY WITH A BOREHOLE PROTECTED AGAINST ABRASION

[75] Inventors: Gerhard Gnadig, Ditzingen; Fritz Przybylla, Heilbronn; Friedrich Schneider, Weissach, all of Fed. Rep. of Germany

[73] Assignee: Werner & Pfleiderer, Stuttgart, Fed. Rep. of Germany

[21] Appl. No.: 443,920

[22] Filed: Nov. 23, 1982

[30] Foreign Application Priority Data

Nov. 25, 1981 [DE] Fed. Rep. of Germany ..... 3146621

[51] Int. Cl.[3] ..... B22D 23/06

[52] U.S. Cl. ..... 164/80; 164/97; 164/338.1

[58] Field of Search ..... 164/80, 97, 66.1, 67.1, 164/68.1, 124, 338.1, 338.2

[56] References Cited

U.S. PATENT DOCUMENTS

| | | | |
|---|---|---|---|
| 2,066,247 | 12/1936 | Brownback | 164/80 |
| 2,887,741 | 5/1959 | Sabel | 164/338.1 X |
| 3,707,035 | 12/1972 | Alger, Jr. et al. | 164/80 X |
| 3,743,556 | 7/1973 | Breton . | |
| 3,888,295 | 6/1975 | Schillinger | 164/80 X |
| 4,222,430 | 9/1980 | Lindner | 164/80 X |

*Primary Examiner*—Kuang Y. Lin

*Assistant Examiner*—P. Weston Musselman, Jr.

*Attorney, Agent, or Firm*—Roberts, Spiecens & Cohen

[57] ABSTRACT

A process for providing abrasion and corrosion resistance in the borehole of a steel body comprising placing an alloying material of solid form within the borehole of the steel body, the alloying material having abrasion and corrosion resistance, and thereafter melting the alloying material in a gas heated protective gas oven to effect diffusion bonding of the alloying material with the steel body and the formation of an abrasion and corrosion resistant lining on the steel body. The borehole is of non-circular shape in cross-section and, particularly, of figure 8 shape as shown in FIG. 2.

5 Claims, 2 Drawing Figures

PROCESS FOR THE MANUFACTURE OF A STEEL BODY WITH A BOREHOLE PROTECTED AGAINST ABRASION

FIELD OF THE INVENTION

The invention relates to a process for the manufacture of a steel body with a borehole protected against abrasion, whereby a diffusion bonding occurs between the steel body and an abrasion- and corrosion-resistant alloying material which is introduced into the borehole.

PRIOR ART

In accordance with one process in practical use, tubular steel bodies are lined with an abrasion- and corrosion-resistant alloy by centrifugal action. For this purpose, the steel body, whose borehole is partially filled with a self-flowing nickel-chromium alloy present in the form of a powder, is set in rotation around its horizontal long axis and at the same time heated to the fusing temperature of the alloying material. This process, however, can only be successfully undertaken with rotation-symmetrical bodies. For other bodies, such as those having a figure eight shaped borehole as is commonly used for two-shaft worm gears, the centrifuge process is not applicable.

Other known possibilities for the application of abrasion- and corrosion-resistant alloying material to steel bodies are the flame spraying process and the arc welding process. Both processes, however, can only be used for the lining of boreholes with large diameter and shallow depth. In addition, uneven surfaces result from the arc welding process, requiring an additional finishing treatment.

Finally, steel bodies can be protected from abrasion and corrosion by having the surface areas which are subject to abrasion coated with a molten alloying material in a casting mold such as is known for example, from German Patent DE-AS No. 26 07 684. To carry out this process, however, a casting installation must be available.

SUMMARY OF THE INVENTION

An object of the invention is to provide a process of the above type in which boreholes of non-circular cross section can be lined with abrasion- and corrosion-resistant alloying materials with minimal expense with respect to apparatus.

This object is satisfied, according to the invention, by introducing the alloying material into the borehole in a solid form and melting the alloying material to bond with the steel body in a gas-heated protective gas oven. Both process stages make possible a flawless coating of boreholes of various configurations in a simple fashion.

The alloying material which is to be introduced into the borehole can be present in a pulverized state, as a granulate or in the form of a dust and can be handled without elaborate precautions. A core of non-fusible material need only be placed inside the borehole, whereupon the intermediate space between the core and the circumference of the borehole can be packed with alloying material. The steel body prepared in this fashion is then placed in a gas-heated protective gas oven, within which the alloying material is brought to its melting point, whereby it enters into a diffusion bond with the steel body. Surprisingly, it was found that fusing of the alloying material occurred satisfactorily only in a gas-heated oven. Attempts to melt the alloying material in an electrically-heated oven failed due to the fact that portions of the molten material were spattered out of the annular space, at the open top, between the circumference of the borehole and the core, forming cavities upon cooling. As an explanation for this phenomenon it was recognized that as a result of electromagnetic force fields, movements were set up within the fluid smelt of such violence that molten material was forced out of said annular space slot by electrodynamic pressure. During experiments which led to the invention, a steel body of 31 CrMoV9 was used, whose borehole was lined with a common nickel-chromium-boron alloy (e.g. 14% Cr,O; 3% C; 3% B; remainder Ni).

DETAILED DESCRIPTION

Figure 1:
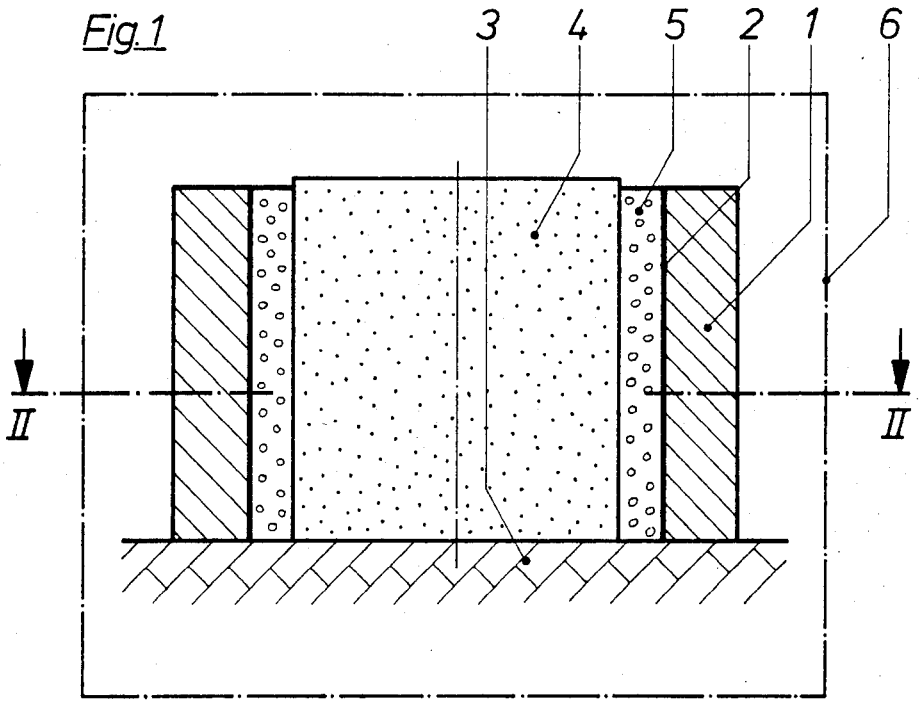
FIG. 1 is a vertical section taken along line I—I in FIG. 2 of apparatus for carrying out the invention.
Figure 2:
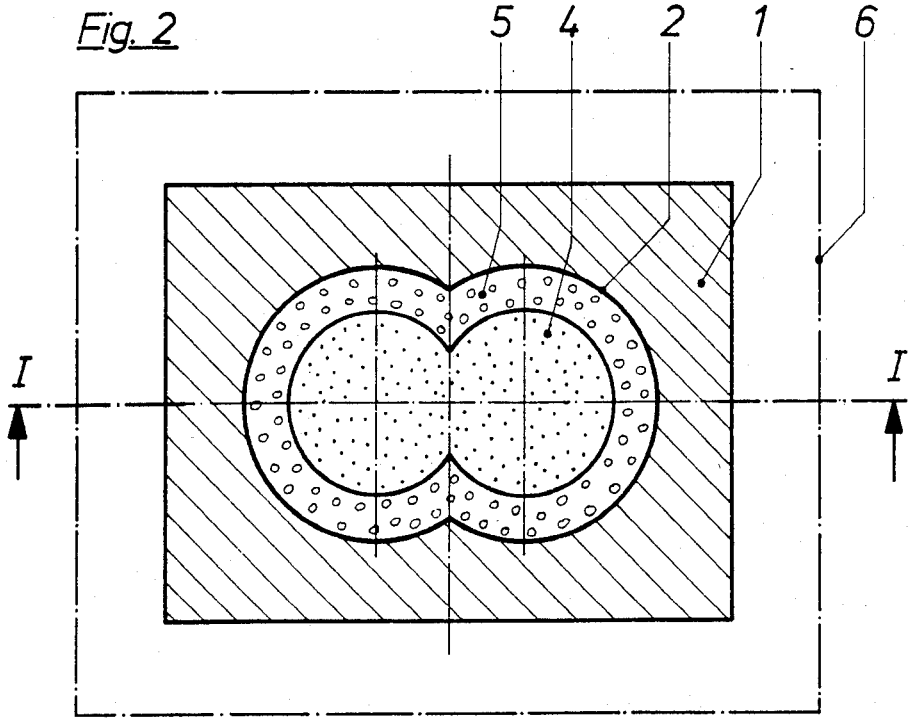
FIG. 2 is a horizontal section taken along line II—II in FIG. 1.

Referring to the drawing, therein is seen a steel member 1 of block shape with a borehole 2 of non-circular cross-section, specifically of figure eight-shape as evident from FIG. 2. The borehole 2 is to be coated with an abrasion and corrosion resistant alloy. For this purpose, a core 4 is placed into the borehole 2 of the steel member 1 and the assembly rests upon a base 3. The core 4 has a smaller cross-sectional area then the borehole 2 to form an annular space therewith. This annular space is filled with an alloying material in solid form such as a granulate and the assembly of the steel member 1, core 4, base 3 and the granulate is placed into a gas heated protective gas oven 6 whose outline is shown by chain-dotted lines. The alloying material is melted in the gas oven 6 to produce diffusion bonding between the steel member 1 and the alloying material. After cooling, the core 4 can be easily removed for subsequent reuse with another steel member 1.

What is claimed is:

1. A process for providing abrasion and corrosion resistance in the borehole of a steel body comprising placing an alloying material of solid form within the borehole of a steel body, said alloying material having abrasion and corrosion resistance, and melting said alloying material in a gas heated protective gas oven without electro-magnetic force to effect diffusion bonding of said alloying material with said steel body and the formation of an abrasion and corrosion resistant lining on said steel body.

2. A process as claimed in claim 1 wherein said borehole is non-circular in cross-section.

3. A process as claimed in claim 2 wherein said borehole is of figure 8 shape in cross-section.

4. A process as claimed in claim 3 wherein said alloying material is in pulverized state.

5. A process as claimed in claim 4 further comprising introducing a core of non-fusible material into said borehole to form an annular space with the steel body, said alloying material being introduced into said space to fill the same.

* * * * *